US011491357B2

(12) United States Patent
Albahish et al.

(10) Patent No.: US 11,491,357 B2
(45) Date of Patent: Nov. 8, 2022

(54) HAZARD DETECTION AND CONTAINMENT

(71) Applicant: Saudi Arabian Oil Company, Dhahran (SA)

(72) Inventors: Sarhan Ali Albahish, Ras Tanura (SA); Soliman A. Al-Wlaaie, Dammam (SA); Osama Bakur Bahwal, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 220 days.

(21) Appl. No.: 16/786,552

(22) Filed: Feb. 10, 2020

(65) Prior Publication Data

US 2021/0244980 A1 Aug. 12, 2021

(51) Int. Cl.

| | |
|---|---|
| ***A62C 31/00*** | (2006.01) |
| ***A62C 3/06*** | (2006.01) |
| ***A62C 25/00*** | (2006.01) |
| ***A62C 27/00*** | (2006.01) |
| ***A62C 37/40*** | (2006.01) |
| ***A62C 99/00*** | (2010.01) |

(52) U.S. Cl.

CPC ..... *A62C 3/065* (2013.01); *A62C 25/005* (2013.01); *A62C 27/00* (2013.01); *A62C 31/00* (2013.01); *A62C 37/40* (2013.01); *A62C 99/009* (2013.01)

(58) Field of Classification Search

CPC ..... A62C 3/00; A62C 3/065; A62C 25/005; A62C 27/00; A62C 31/00; A62C 37/40; A62C 99/009

USPC ..... 169/47

See application file for complete search history.

(56) References Cited

U.S. PATENT DOCUMENTS 5,686,694 A * 11/1997 Hillenbrand ..... B63G 8/38 114/21.2
5,713,293 A * 2/1998 Shiffler ..... B63B 1/04 114/61.27
5,769,676 A * 6/1998 Ortiz-Flotats ..... B60F 3/0061 440/12.57

(Continued)

FOREIGN PATENT DOCUMENTS

EP 1534394 6/2005

OTHER PUBLICATIONS

Horell, "Testing the waters: a new challenge for the wireless power lab drone," Imperial College London, Jun. 2019, 6 pages.

(Continued)

*Primary Examiner* — Chee-Chong Lee

(74) *Attorney, Agent, or Firm* — Fish & Richardson P.C.

(57) ABSTRACT

Multiple robotic monitors are located in a hydrocarbon storage or transport facility. Each robotic monitor is communicably coupled to other robotic monitors and includes a heat sensor configured to detect heat emitted by a hydrocarbon tank of the hydrocarbon storage or transport facility. A controller is communicably coupled to the heat sensor and configured to generate a heat signature based on the heat detected by the heat sensor. A pump is communicably coupled to the controller and configured to exert pressure on a fire retardant, responsive to the generation of the heat signature by the controller. An outlet is mechanically coupled to the pump and configured to discharge the fire retardant at the hydrocarbon tank.

18 Claims, 4 Drawing Sheets

(56) References Cited

U.S. PATENT DOCUMENTS

| | | | | |
|---|---|---|---|---|
| 5,995,882 | A * | 11/1999 | Patterson | B63C 11/42 114/312 |
| 6,269,763 | B1 * | 8/2001 | Woodland | F41H 9/02 114/382 |
| 9,192,798 | B2 | 11/2015 | Dunster et al. | |
| 9,440,102 | B2 | 9/2016 | Fernstrum et al. | |
| 9,878,787 | B2 | 1/2018 | Chan et al. | |
| 2008/0017393 | A1 | 1/2008 | Whitney | |
| 2011/0155397 | A1 | 6/2011 | Icove et al. | |
| 2016/0354626 | A1 | 12/2016 | McNamera et al. | |
| 2017/0015414 | A1 | 1/2017 | Chan et al. | |
| 2017/0015415 | A1 | 1/2017 | Chan et al. | |

OTHER PUBLICATIONS

Junaid et al., "Autonomous Wireless Self-Charging for Multi-Rotor Unmanned Aerial Vehicles," Energies, 2017, 10:803, 14 pages.

Loughran, "Wirelessly Powered Drone Enables Indefinite Flight Time," E&T, Engineering and Technology, Oct. 20, 2016, retrieved on Jul. 19, 2021, retrieved from URL <https://eandt.theiet.org/content/articles/2016/10/wirelessly-powered-drone-enables-indefinite-flight-time/>, 6 pages.

Rasi et al., "New Method for Data Communication over Power-Line Career," International Journal of Advanced Biotechnology and Research (IJBR), Jul. 2016, 7(5):993-1002, 11 pages.

PCT International Search Report and Written Opinion in International Appln. No. PCT/US2021/016457, dated Apr. 26, 2021, 15 pages.

Akronbrass.com, [online], "3486 StreamMaster II with AVM 2000 GPM (7600 LPM)," retrieved from URL <https://www.akronbrass.com/monitors/stream-master-ii-with-avm>, retrieved on Feb. 6, 2020, available on or before 2019, 3 pages.

Angus Fire, "Firefighting Monitors," retrieved from URL <https://angusfire.co.uk/wp-content/uploads/Monitors-8pp-Brochure-RS.pdf>, retrieved on Feb. 6, 2020, available on or before Dec. 1, 2019, 8 pages.

Crdsolution.com, [online], "Automatic Fire Water Monitor," retrieved from URL <cfdsolution.com/automatic-fire-water-monitor/>, retrieved on Feb. 6, 2020, available on or before 2016, 2 pages.

* cited by examiner

HAZARD DETECTION AND CONTAINMENT

TECHNICAL FIELD

This description relates generally to hydrocarbon storage and transport, for example, to a hazard detection and containment system for hydrocarbon storage and transport.

BACKGROUND

Hydrocarbon storage and transport can pose several challenges. Recorded hazardous events include oil spills at terminals or by vessel leakage, piracy, and fires and explosions from flammable material. Hazards can damage the environment, cause human and equipment loss, and impact the reputation of the company. For example, a hazard can lead to extra costs of oil recovery and compensation to impacted entities.

SUMMARY

The implementations disclosed provide methods, apparatus, and systems for robotic hazard detection and containment for hydrocarbon storage and transport. Multiple robotic monitors are located in a hydrocarbon storage or transport facility. Each robotic monitor is communicably coupled to other robotic monitors and includes a heat sensor configured to detect heat emitted by a hydrocarbon tank of the hydrocarbon storage or transport facility. A controller is communicably coupled to the heat sensor and configured to generate a heat signature based on the heat detected by the heat sensor. A pump is communicably coupled to the controller and configured to exert pressure on a fire retardant responsive to the generation of the heat signature by the controller. An outlet is mechanically coupled to the pump and configured to discharge the fire retardant at the hydrocarbon tank.

In some implementations, the heat signature represents a first location of the hydrocarbon tank and a second location of a second hydrocarbon tank of the hydrocarbon storage or transport facility. The second hydrocarbon tank is adjacent to the hydrocarbon tank.

In some implementations, each robotic monitor further includes an inertial measurement unit configured to determine a location of the robotic monitor relative to the hydrocarbon tank. The controller includes a machine learning module configured to extract a feature vector based on the heat detected by the heat sensor and the location of the robotic monitor relative to the hydrocarbon tank.

In some implementations, the machine learning module is further configured to provide the heat signature based on the feature vector. The heat signature represents an area of the hydrocarbon storage or transport facility corresponding to a surface of the hydrocarbon tank.

In some implementations, the robotic monitor is configured to move in accordance with four or more degrees of freedom.

In some implementations, the heat sensor is a radiometric heat sensor or a thermal camera.

In some implementations, one or more unmanned aerial vehicles (UAVs) are communicably coupled to the robotic monitors and configured to transmit aerial images of the hydrocarbon storage or transport facility to the robotic monitors.

In some implementations, the controller is further configured to generate a second heat signature based on the aerial images.

In some implementations, the controller is further configured to launch the one or more UAVs from the hydrocarbon storage or transport facility, responsive to generating the heat signature.

In some implementations, multiple flame detectors are communicably coupled to the robotic monitors and configured to detect ultraviolet (UV) radiation emitted by the hydrocarbon tank. A signal representing the UV radiation is transmitted to the robotic monitors.

DETAILED DESCRIPTION

The implementations disclosed provide methods, apparatus, and systems for robotic hazard detection and containment for hydrocarbon storage and transport. The implementations enable intelligent robotic firefighting monitors for oil and gas tanks and vessels. The implementations can detect and assess hazardous events, and actuate, and enable an autonomous fire extinguishing agent onto a tank or vessel. The robotic firefighting apparatus can be fixed at a location or mobile. The implementations further cool and contain fires on tanks or vessels using pre-action nozzles during a fire incident to inhibit the spread of the fire spread, prevent violent tank ruptures, and distance firefighting personnel from the hazard location during defensive or nonintervention fire suppression activities. The implementations autonomously detect a heat signature using artificial intelligence (AI) algorithms, determine locations of adjoining tanks, and discharge cooling effects onto the exposed sides of tanks or storage vessels exposed to or involved in the fire. The implementations can operate in different modes, such as autonomous, semi-autonomous, or manual, and can be integrated with unmanned aerial vehicles (UAVs) to enhance fire containment, protect a company's assets, and reduce the likelihood of firefighter causalities during complex and dangerous emergencies. The implementations provide an agile response to and holistic management of fire incidents.

Figure 1:
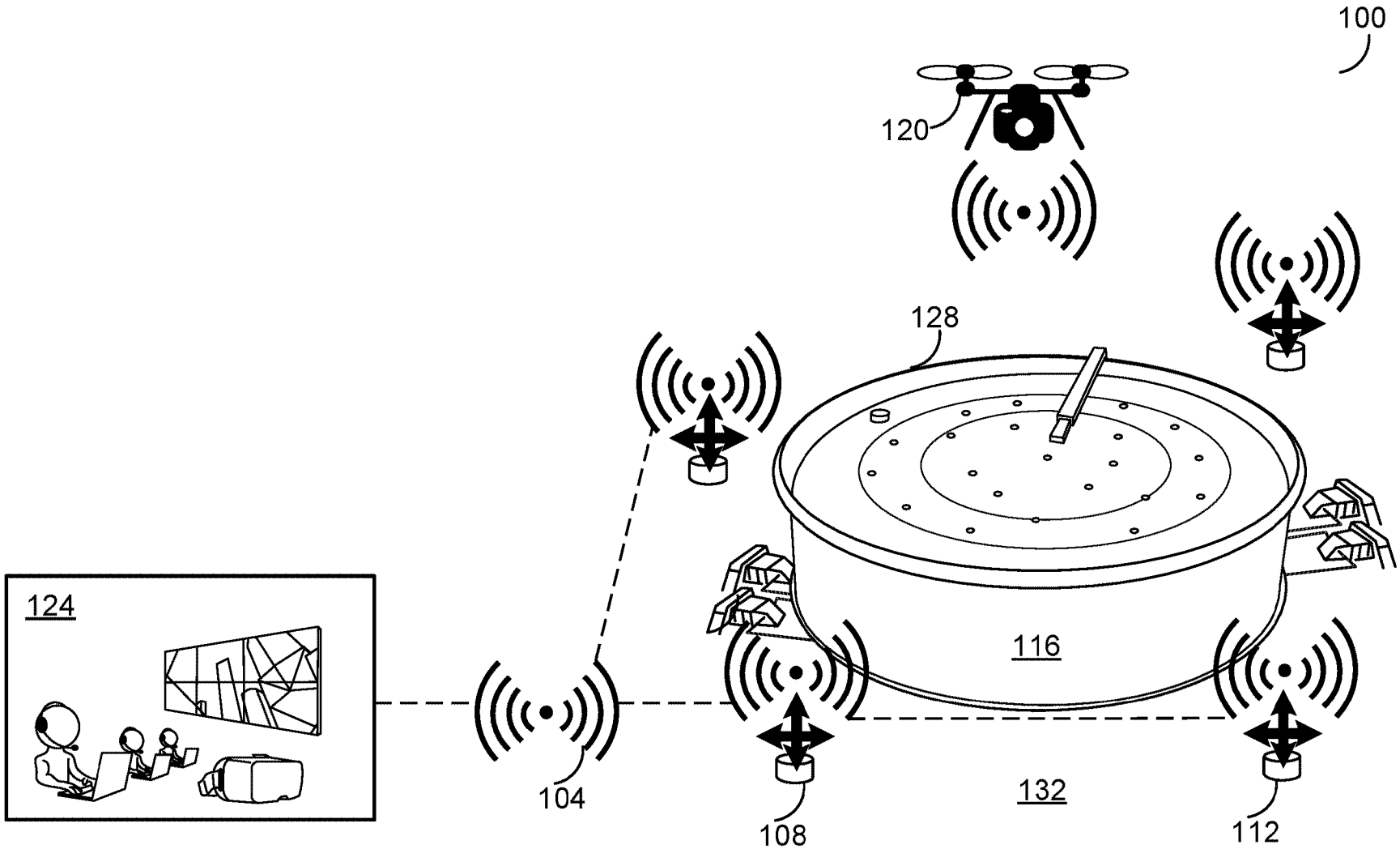
FIG. 1 illustrates a hazard detection and containment system.

FIG. 1 illustrates a robotic hazard detection and containment system 100. The hazard detection and containment system 100 includes a robotic monitor 108, sometimes referred to as an "intelligent Automated Robotic Monitor (iARM)" for intelligent robotic firefighting for oil and gas (O&G) tanks and vessels. The hazard detection and containment system 100 includes multiple robotic monitors 108, 112 located in a hydrocarbon storage or transport facility 132. For example, the hydrocarbon storage or transport facility 132 can be used for movement of crude oil from the oil fields to petroleum refineries to storage areas where the petroleum products are stored for distribution or emergency reserves. The robotic monitors 108, 112 can be constructed using the components described with reference to FIG. 4. The robotic monitors 108, 112 detect an origin of a hazard, for example, a fire in the hydrocarbon storage or transport facility 132. In some implementations, the robotic monitors 108, 112 detect a fire in underground storage having only a few centimeters of visibility. The robotic monitors 108, 112 can detect a fire by analyzing thermal events such as flashover, backdraft, or smoke explosion. Therefore, the hazard detection and containment system 100 detects, assesses, actuates, and provides automated fire extinguishing agents onto a tank or vessel using fixed or mobile iARMs.

Each robotic monitor, for example the robotic monitor 108, is communicably coupled to other robotic monitors, for example the robotic monitor 112, over a network 104. For example, the robotic monitor 108 can include a communication interface that provides a two-way data communication coupling to a network link that is connected to the network 104. For example, the communication interface can include an integrated service digital network (ISDN) card, cable modem, satellite modem, or a modem to provide a data communication connection to a corresponding type of telephone line. As another example, the communication interface is a local area network (LAN) card to provide a data communication connection to a compatible LAN. In some implementations, wireless links are also implemented. In any such implementation, the communication interface sends and receives electrical, electromagnetic, or optical signals that carry digital data streams representing various types of information.

The robotic monitor 108 includes a heat sensor, for example, the heat sensor 300, illustrated and described with reference to FIG. 3. In some implementations, the heat sensor 300 is a temperature sensor, such as a long-range temperature monitor. Such sensors are sometimes used for wildland fire detection. In other implementations, the sensor is a thermal infrared imager, such as used for long-range surveillance. The heat sensor 300 is configured to detect heat emitted by a hydrocarbon tank 128 of the hydrocarbon storage or transport facility 132. For example, a fuel-air explosion in a vapor cloud of evaporated leaking fuel can lead to a fire and emission of heat. The robotic monitor 108 includes a controller, for example, the controller 316, illustrated and described with reference to FIG. 3. The controller 316 can be constructed using the components described with reference to FIG. 4.

The controller 316 is communicably coupled to the heat sensor 300 and configured to generate a heat signature based on the heat detected by the heat sensor 300. For example, the heat signature can represent a shape, size, temperature, or emissivity of a surface 116 of the hydrocarbon tank 128. In some implementations, the heat signature can represent a reflection of heat from a surface of a hydrocarbon tank, for example, the hydrocarbon tank 416, illustrated in FIG. 4. The hydrocarbon tank 416 in FIG. 4 can reflect heat emitted by the hydrocarbon tank 128 illustrated in FIG. 4. The heat signature can also depend on the a waveband of the heat sensor 300. In some implementations, the heat signature is an infrared signature representing one or more of a shape of a surface area of the hydrocarbon tank 416, a size of the surface area of the hydrocarbon tank 416, a temperature emission from the hydrocarbon tank 416, a reflectivity of the surface area of the hydrocarbon tank 416, a material of the surface 116 of the hydrocarbon tank 416. A detection range or waveband of the heat sensor 300 can be preset to determine if there a fire is present based on the heat signature.

The robotic monitor 108 includes a pump, for example, the pump 308, illustrated and described with reference to FIG. 3. The pump 308 is communicably coupled to the controller 316 and configured to inject or release a fire retardant, responsive to the generation of the heat signature. In some implementations, the pump 308 functions as an injector to collect a supplemental agent (either foam or dry chemical) from a separate feed line. The supplemental agent is injected into a water stream to extinguish a fire. The pump 308 is sometimes referred to as an "automatic hydro-chemical monitor nozzle."

The robotic monitor 108 includes an outlet, for example, the outlet 312, illustrated and described with reference to FIG. 3. The outlet 312 is mechanically coupled to the pump 308 and configured to discharge the fire retardant at the hydrocarbon tank 128. In some implementations, the fire retardant acts as a supplemental agent to water used for firefighting. The fire retardant can perform one or more of the following functions: the dry chemical or foam can act to smother, cool the fire, suppress the fire, or combine with water to extinguish the fire. In some implementations, therefore, the hazard detection and containment system 100 cools and contains a fire on a tank or vessel using pre-action nozzles during a fire incident to inhibit fire spread, prevent violent tank ruptures, and distance firefighting personnel during defensive or non-intervention fire suppression activities.

The robotic monitor 108 is configured to move in accordance with four or more degrees of freedom. A degree of freedom of the robotic monitor 108 refers to a number of independent parameters that define its physical motion. In some implementations, the physical motion of the robotic monitor 108 is defined in terms of N-dimensional translation or rotation, where N is greater than or equal to four. In some implementations, the degrees of freedom of movement of the robotic monitor 108 can include translation and rotation, moving up and down, moving left and right, moving forward and backward, swiveling left and right, tilting forward and backward, or pivoting side to side.

The hazard detection and containment system 100 further includes one or more unmanned aerial vehicles (UAVs) 120 that are communicably coupled to the robotic monitors 108, 112 and configured to transmit aerial images of the hydrocarbon storage or transport facility 132 to the robotic monitors 108, 112. A UAV refers to an aircraft or flying vehicle with no pilot on board. The UAV 120 can be constructed using the components described with reference to FIG. 4. The UAV 120 can be remote controlled by the robotic monitor 108 or control computers 124. The control computers 124 can be constructed using the components described with reference to FIG. 4. The UAV 120 can fly autonomously based on pre-programmed flight plans or more complex dynamic automation systems. The UAV 120 can be used for reconnaissance of the hydrocarbon storage or transport facility 132. In some implementations, the controller 316 is further configured to launch the UAV 120 from a floor or launchpad of the hydrocarbon storage or transport facility 132, responsive to generating the heat signature. The UAV 120 can provide 360° views and identify hotspots.

In some implementations, the hazard detection and containment system 100 can operate in one of several different modes that are autonomously, semi-autonomously, or manually and integrated with the UAV 120 to enhance fire containment, protect the company's assets, and reduce the likelihood of firefighter causalities while addressing complex and dangerous emergencies. The hazard detection and containment system 100 provide an agile response and holistic management of fire incidents using iARMs integrated with the UAVs 120. In some implementations, the controller is further configured to generate a second heat signature based on the aerial images. The second heat signature cna be a "heat map" or a graphical representation of heat emission values contained in a shaded matrix.

Figure 2:
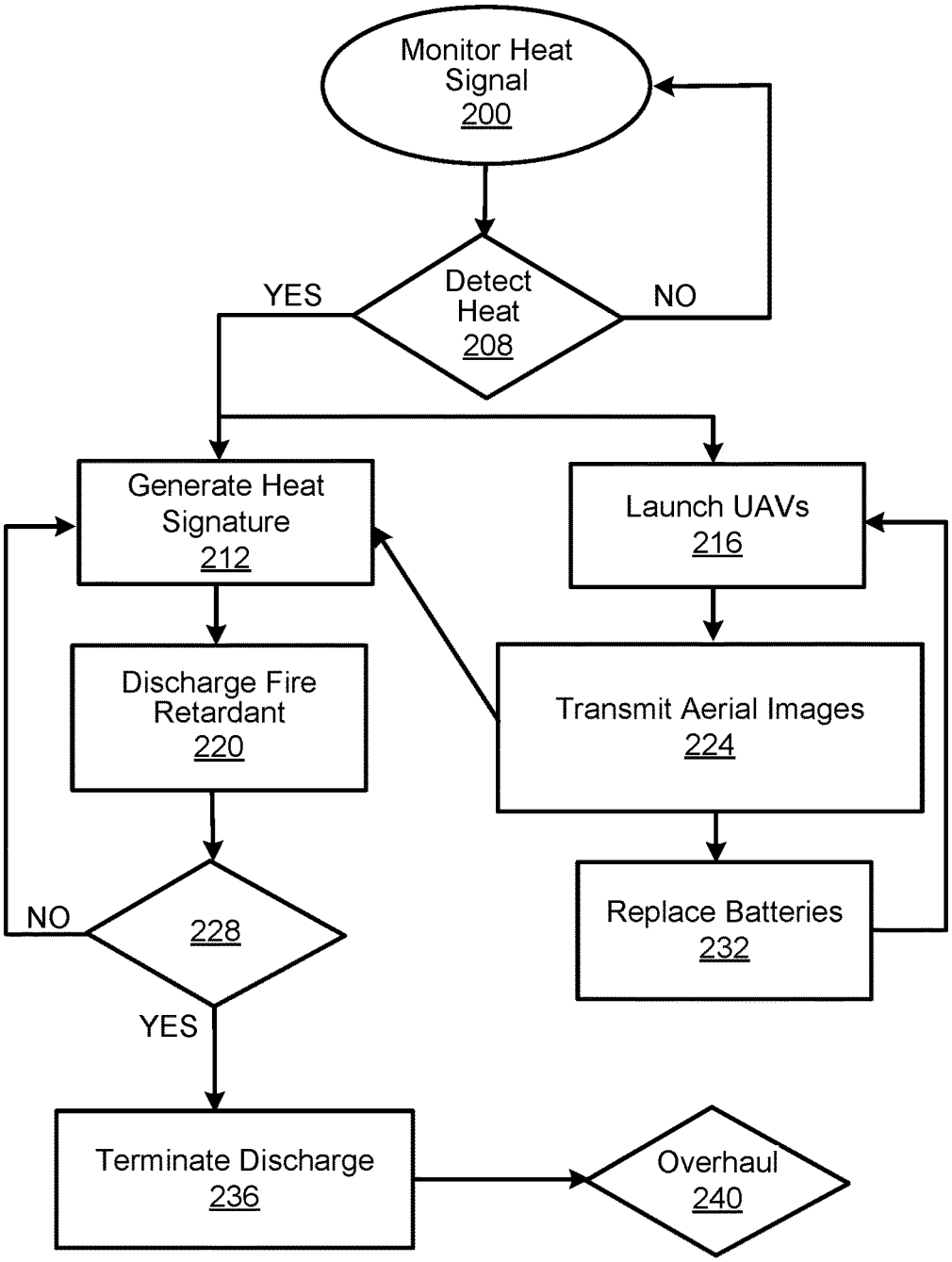
FIG. 2 illustrates a process for hazard detection and containment.

FIG. 2 illustrates a process for robotic hazard detection and containment. In some implementations the process of FIG. 2 is performed by the hazard detection and containment system 100, illustrated and described in more detail with reference to FIG. 1. The hazard detection and containment system 100 includes the robotic monitors 108, 112 located in the hydrocarbon storage or transport facility 132, illustrated and described in more detail with reference to FIG. 1. The robotic monitor 108 is communicably coupled to the robotic monitor 112. The robotic monitor 108 includes the heat sensor 300, illustrated and described in more detail with reference to FIG. 1. The heat sensor 300 is configured to detect heat emitted by the hydrocarbon tank 128, illustrated and described in more detail with reference to FIG. 1. The robotic monitor 108 includes the controller 316, illustrated and described in more detail with reference to FIG. 3. The controller 316 is communicably coupled to the heat sensor 300 and configured to generate a heat signature based on the heat detected by the heat sensor 300. The robotic monitor 108 includes the pump 308, illustrated and described in more detail with reference to FIG. 3. The pump 308 is communicably coupled to the controller 316 and configured to exert pressure on a fire retardant, responsive to the generation of the heat signature by the controller 316. The robotic monitor 108 includes the outlet 312, illustrated and described in more detail with reference to FIG. 3. The outlet 312 is mechanically coupled to the pump 308 and configured to discharge the fire retardant at the hydrocarbon tank 128.

In step 200, the controller 316 periodically monitors a heat signal from the heat sensor 300. For example, the controller 316 cna monitor the heat signal every few seconds. The heat signal indicates to the controller 316 that the heat sensor has detected heat emitted by the hydrocarbon tank 128. In step 208, the heat sensor 300 detects heat emitted by the hydrocarbon tank 128. Therefore, the controller 316 enters a "hazard detected" state of operation. If no heat is detected, the controller remains in a "no hazard" state of operation and returns to step 200.

In step 212, the controller 316 generates a heat signature based on the heat detected by the heat sensor 300. The heat signature is described in more detail with reference to FIG. 1. In step 220, the hazard detection and containment system 100 discharges a fire retardant at the hydrocarbon tank 128. For example, the pump 308 is communicably coupled to the controller 316 and configured to exert pressure on the stored fire retardant, responsive to the generation of the heat signature by the controller 316. The outlet 312 is mechanically coupled to the pump 308 and configured to discharge the fire retardant at the hydrocarbon tank 128. In step 228, the hazard detection and containment system 100 determines whether the fire has been contained. The hazard detection and containment system 100 receives data from the heat sensor 300 and controller 316 to determine the status of the fire.

If the fire has not been contained, the hazard detection and containment system 100 returns to and performs step 212. The hazard detection and containment system 100 actuates the pump 308 and supplemental agent to discharge at the fire. If the fire has been contained, the hazard detection and containment system 100 progresses to and performs step 236. In step 236, the hazard detection and containment system 100 terminates the discharge of the fire retardant. In step 240, one or more components of the hazard detection and containment system 100, such as the robotic monitors 108, 112 are overhauled. The overhaul process includes actuation of the hazard detection and containment system 100, including the pump 308, to provide water for continued tank cooling based on feedback from wavelength parameters of the heat sensor 300.

From step 208, once the heat sensor 300 detects the heat, the hazard detection and containment system 100 can alternatively or simultaneously perform step 216. In step 216, the hazard detection and containment system 100 is configured to launch one or more UAVs 120 from the hydrocarbon storage or transport facility 132, responsive to generating the heat signature. The UAVs 120 are illustrated and described in more 3 detail with reference to FIG. 1. In step 224, the UAV 120 is configured to transmit aerial images of the hydrocarbon storage or transport facility 132 to the robotic monitors 108, 112. The UAV 120 is communicably coupled to the robotic monitors 108, 112 over the network 104. The system can perform step 212 by generating a second heat signature based on the aerial images. For example, the second heat signature can represent the hydrocarbon storage or transport facility 132. The second heat signature cna be a two-dimensional (2D) or three-dimensional (3D) display of the values in a data matrix. The second heat signature can include clusters by permuting the rows and the columns of a matrix to place similar values near each other. The clustering can indicate locations of a fire. In step 232, the batteries of the UAV 120 can be replaced or recharged. The UAV 120 cna be powered by lithium-polymer batteries (Li—Po). Battery elimination circuitry (BEC) can centralize power distribution using a microcontroller unit.

Figure 3:
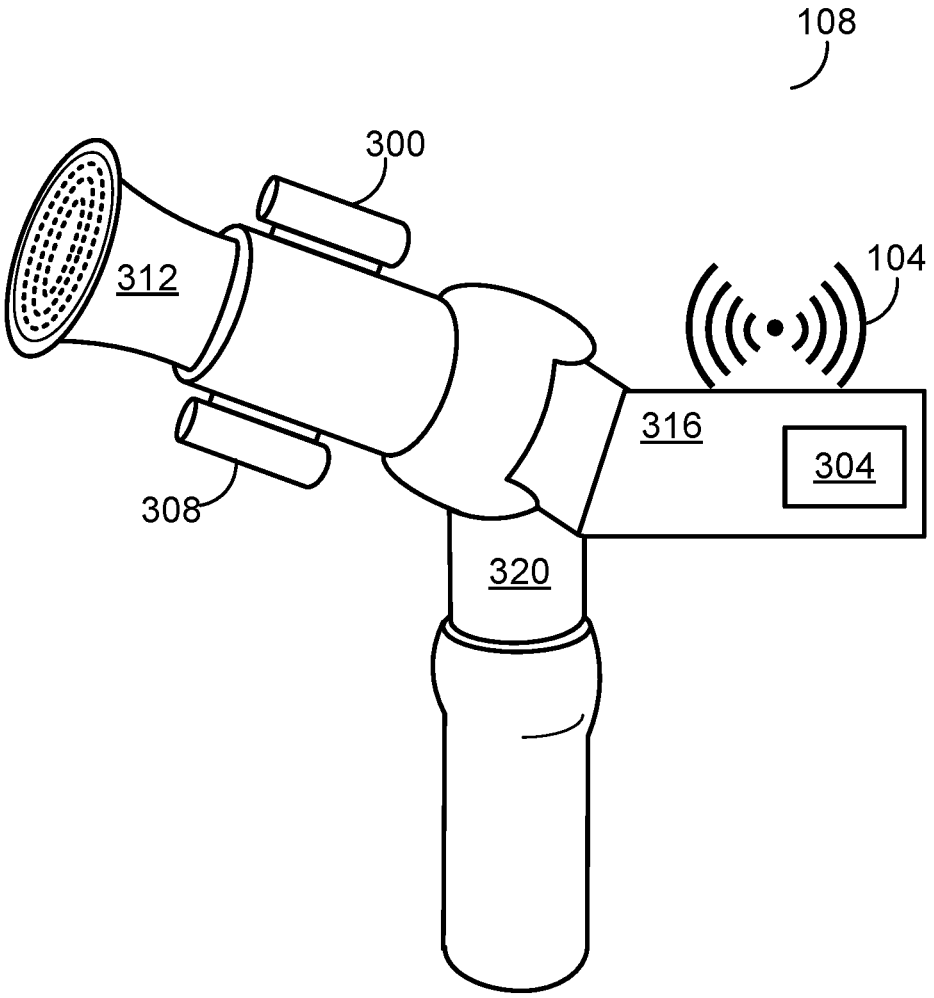
FIG. 3 illustrates a portion of a robotic monitor.

FIG. 3 illustrates a portion of a robotic monitor 108. The hazard detection and containment system 100, illustrated and described in more detail with reference to FIG. 1, includes the robotic monitor 108. The robotic monitor 108 is located in the hydrocarbon storage or transport facility 132, illustrated and described in more detail with reference to FIG. 1. The robotic monitor 108 is communicably coupled to the robotic monitor 112, illustrated and described with reference to FIG. 1 over the network 104. The robotic monitor 108 includes a heat sensor 300 configured to detect heat emitted by the hydrocarbon tank 128, illustrated and described in more detail with reference to FIG. 1. The heat sensor 300 can be a radiometric heat sensor or a thermal camera. A radiometric heat sensor refers to a device that measures the temperature of a surface, for example, the surface 116 in FIG. 1. A thermal camera interprets the intensity of an infrared signal reaching the thermal camera from locations of the hydrocarbon storage or transport facility 132. The heat sensor 300 can also save pictures for post-fire-containment analysis by measuring the temperatures represented by individual image pixels.

The robotic monitor 108 includes a controller 316 communicably coupled to the heat sensor 300 and configured to generate a heat signature based on the heat detected by the heat sensor 300. The robotic monitor 108 includes a pump 308 communicably coupled to the controller 316 and configured to exert pressure on a fire retardant, responsive to the generation of the heat signature by the controller 316. The robotic monitor 108 includes an outlet 312 mechanically coupled to the pump 308 and configured to discharge the fire retardant at the hydrocarbon tank 128.

Figure 4:
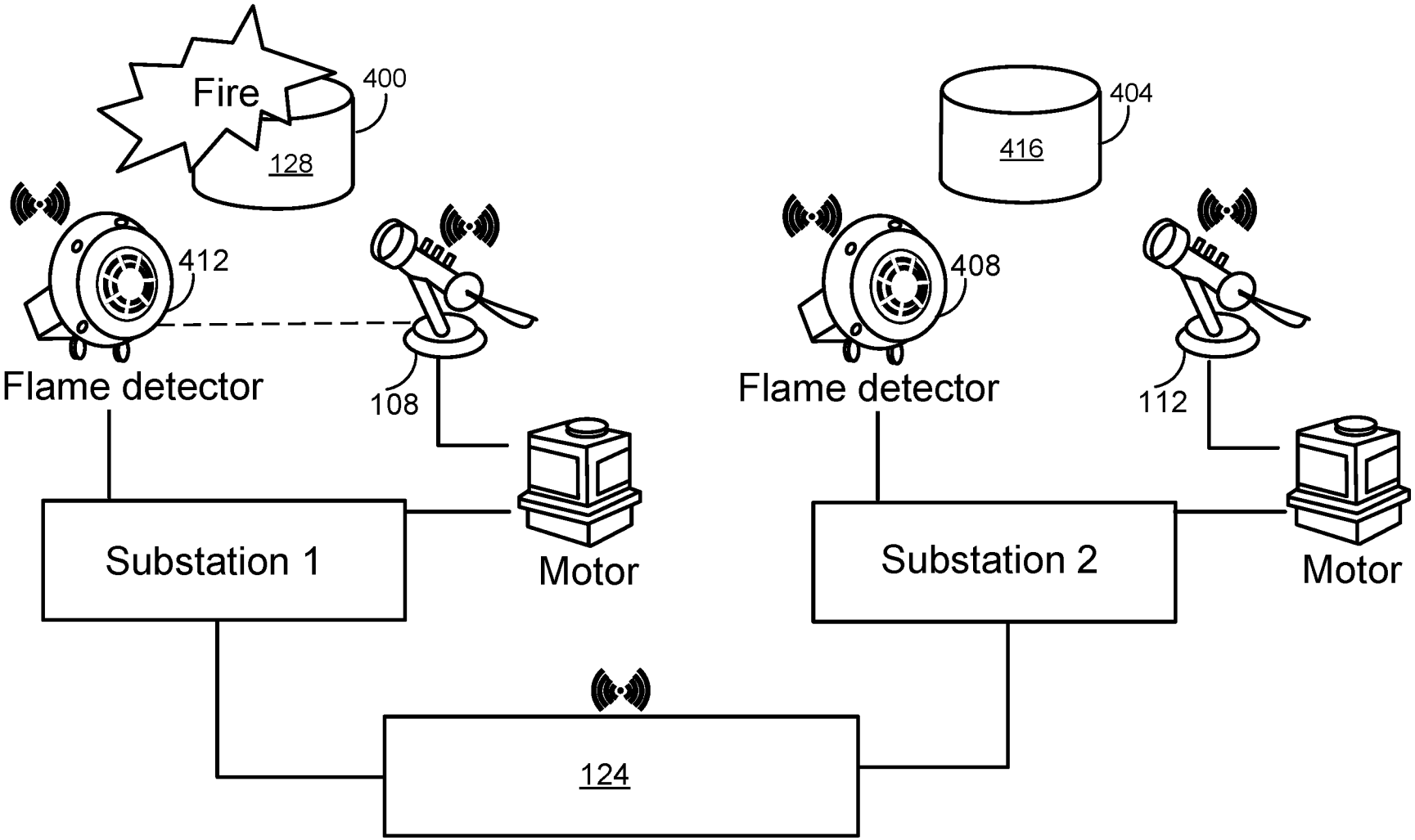
FIG. 4 illustrates an environment for a hazard detection and containment system.

In some implementations, the robotic monitor 108 includes an (inertial measurement unit) 320 configured to determine a location of the robotic monitor 108 relative to the hydrocarbon tank 128. For example, a location 400 of the hydrocarbon tank 128 is illustrated in FIG. 4. The IMU 320 is an electronic component that that measures a specific force, angular rate, or orientation of the robotic monitor 108. The IMU 320 can include an accelerometer, a gyroscope, or a magnetometer.

In some implementations, the controller 316 includes a machine learning module 304 configured to extract a feature vector based on the heat detected by the heat sensor 300 and the location of the robotic monitor 108 relative to the hydrocarbon tank 128. The machine learning module 304 can be implemented in software using a computer processor or in special-purpose hardware, as described with reference to FIG. 4. The machine learning module 304 reduces redundancy in the heat data and location data by transforming the data into a reduced set of features (the feature vector). The feature vector contains the relevant information from the data, such that features of interest are identified by the machine learning module 304 using the reduced representation instead of the complete data.

The machine learning module 304 includes a mathematical and connectivity model that is trained using the feature vector to make predictions or decisions without being explicitly programmed. The controller 316 can use one or more machine learning methods to train the machine learning module 304 using stored feature vectors known as training data. In some implementations, a K-nearest neighbors method is used. The K-nearest neighbors method can be used for classification and regression. In some implementations, a support vector machine method is used. Support vector machines use supervised learning to train the machine learning module 304 with associated learning algorithms that analyze the training data. The machine learning module 304 is further configured to provide the heat signature based on the feature vector. For example, the heat signature can represent an area of the hydrocarbon storage or transport facility 132 that corresponds to a surface 116 of the hydrocarbon tank 128. In some implementations, the heat signature is determined by the machine learning module 304 using artificial intelligence. The controller 316 uses the machine learning module 304 to determine when to discharge water or the fire retardant onto nearby hydrocarbon tanks (for example, the hydrocarbon tank 416) and their exposed areas proximal to the detected fires surface. The machine learning module 304 further determines the radiant heat from the burning hydrocarbon tank 128 and provies instructions to the controller 316. In some implementations, therefore, the hazard detection and containment system 100 operates autonomously by generating the heat signature using artificial intelligence (AI) algorithms, determining locations of adjoining tanks, and discharging a fire retardant to provide cooling effects onto exposed sides of tanks or storage vessels involved in a fire.

FIG. 4 illustrates an environment for the hazard detection and containment system 100. The hazard detection and containment system 100 includes the robotic monitors 108, 112 located in a hydrocarbon storage or transport facility 132. The robotic monitor 108 is communicably coupled to the robotic monitor 112. The robotic monitors 108, 112 include heat sensors, for example the heat sensor 300, configured to detect heat emitted by the hydrocarbon tanks 128, 416 of the hydrocarbon storage or transport facility 132. The robotic monitor 108 includes a controller 316 communicably coupled to the heat sensor 300 and configured to generate a heat signature based on the heat detected by the heat sensor 300. The robotic monitor 108 includes a pump 308 communicably coupled to the controller 316 and configured to exert pressure on a fire retardant, responsive to the generation of the heat signature. The robotic monitor 108 includes an outlet 312 mechanically coupled to the pump 308 and configured to discharge the fire retardant at the hydrocarbon tank 128.

In some implementations, the heat signature represents a first location 400 of the hydrocarbon tank 128. The heat signature can also represent a second location 404 of a second hydrocarbon tank 416 of the hydrocarbon storage or transport facility 132. The second hydrocarbon tank 416 is adjacent to the hydrocarbon tank 128. The second hydrocarbon tank 416 and multiple other adjacent tanks of the hydrocarbon storage or transport facility 132 can sometimes be exposed to high temperatures from the radiant heat of large fires. The exposure can compound the fire hazard. Hence, the hazard detection and containment system 100 also monitors and cools, if necessary, surrounding and adjacent hydrocarbon tanks to prevent secondary ignitions and additional damage. In some implementations, the hazard detection and containment system 100 includes multiple flame detectors 412, 408 communicably coupled to the robotic monitors 108, 112. The flame detector 412 is configured to detect ultraviolet (UV) radiation emitted by the hydrocarbon tank 128. For example, the flame detector 412 can be an optical flame detector, such as a UV detector, an infrared (IR) flame detector, or an IR thermal camera. In some implementations, the flame detector 412 is a visible sensor, such as a video camera. In some implementations, the flame detector 412 is an ionization current flame detector or a thermocouple flame detector. The flame detector 412 transmits a signal representing the UV radiation to the robotic monitors 108, 112 for followup firefighting operation.

The methods described can be performed in any sequence and in any combination, and the components of respective embodiments can be combined in any manner. The machine-implemented operations described above can be implemented by a computer system that includes programmable circuitry configured by software or firmware, or a special-purpose circuit, or a combination of such forms. Such a special-purpose circuit can be in the form of, for example, one or more application-specific integrated circuits (ASICs), programmable logic devices (PLDs), field-programmable gate arrays (FPGAs), or system-on-a-chip systems (SOCs).

A computer system can generate a graphical representation of any output data produced using a display device of the computer system. The graphical representation can include a histogram, a pie chart, or a bar graph. In some implementations, the computer system is coupled via a bus to a display device, such as a cathode ray tube (CRT), a liquid crystal display (LCD), plasma display, light emitting diode (LED) display, or an organic light emitting diode (OLED) display for displaying information to a computer user.

Software or firmware to implement the techniques introduced here can be stored on a non-transitory machine-readable storage medium and executed by one or more general-purpose or special-purpose programmable microprocessors. A machine-readable medium, as the term is used, includes any mechanism that can store information in a form accessible by a machine (a machine can be, for example, a computer, network device, cellular phone, personal digital assistant (PDA), manufacturing tool, or any device with one or more processors). For example, a machine-accessible medium includes recordable or non-recordable media (RAM or ROM, magnetic disk storage media, optical storage media, or flash memory devices).

The term "logic," as used herein, means: i) special-purpose hardwired circuitry, such as one or more application-specific integrated circuits (ASICs), programmable logic devices (PLDs), field programmable gate arrays (FPGAs), or other similar device(s); ii) programmable circuitry programmed with software and/or firmware, such as one or more programmed general-purpose microprocessors, digital signal processors (DSPs) or microcontrollers, system-on-a-chip systems (SOCs), or other similar device(s); or iii) a combination of the forms mentioned in i) and ii).

What is claimed is:

1. A system comprising:

a plurality of robotic monitors located in a hydrocarbon storage or transport facility, each robotic monitor of the plurality of robotic monitors communicably coupled to other robotic monitors of the plurality of robotic monitors and comprising:

a heat sensor configured to detect heat emitted by a hydrocarbon tank of the hydrocarbon storage or transport facility;

a controller communicably coupled to the heat sensor and configured to generate a heat signature based on the heat detected by the heat sensor, wherein the each robotic monitor further comprises an inertial measurement unit configured to determine a location of the each robotic monitor relative to the hydrocarbon tank, and the controller comprises a processor configured to extract a feature vector based on the heat detected by the heat sensor and the location of the each robotic monitor relative to the hydrocarbon tank;

a pump communicably coupled to the controller and configured to exert pressure on a fire retardant, responsive to generating, by the controller, the heat signature; and an outlet mechanically coupled to the pump and configured to discharge the fire retardant at the hydrocarbon tank.

2. The system of claim 1, wherein the heat signature represents:

a first location of the hydrocarbon tank; and a second location of a second hydrocarbon tank of the hydrocarbon storage or transport facility, the second hydrocarbon tank adjacent to the hydrocarbon tank.

3. The system of claim 1, wherein the machine learning module is further configured to provide the heat signature based on the feature vector, the heat signature representing an area of the hydrocarbon storage or transport facility corresponding to a surface of the hydrocarbon tank.

4. The system of claim 1, wherein the each robotic monitor is configured to move in accordance with four or more degrees of freedom.

5. The system of claim 1, wherein the heat sensor is a radiometric heat sensor or a thermal camera.

6. The system of claim 1, further comprising one or more unmanned aerial vehicles (UAVs) communicably coupled to the plurality of robotic monitors and configured to transmit aerial images of the hydrocarbon storage or transport facility to the plurality of robotic monitors.

7. The system of claim 6, wherein the controller is further configured to generate a second heat signature based on the aerial images.

8. The system of claim 6, wherein the controller is further configured to launch the one or more UAVs from the hydrocarbon storage or transport facility, responsive to generating the heat signature.

9. The system of claim 1, further comprising a plurality of flame detectors communicably coupled to the plurality of robotic monitors and configured to:

detect ultraviolet (UV) radiation emitted by the hydrocarbon tank; and transmit a signal representing the UV radiation to the plurality of robotic monitors.

10. A method, comprising:

detecting, by a heat sensor of a robotic monitor, heat emitted by a hydrocarbon tank of a hydrocarbon storage or transport facility, the robotic monitor being one of a plurality of robotic monitors located in the hydrocarbon storage or transport facility, each robotic monitor of the plurality of robotic monitors communicably coupled to other robotic monitors of the plurality of robotic monitors;

generating, by a controller of the robotic monitor, a heat signature based on the heat detected by the heat sensor, the controller communicably coupled to the heat sensor;

exerting, by a pump of the robotic monitor, pressure on a fire retardant, responsive to generating, by the controller, the heat signature, the pump communicably discharging, by an outlet of the robotic monitor, the fire retardant at the hydrocarbon tank, the outlet mechanically coupled to the pump;

determining, by an inertial measurement unit of the robotic monitor, a location of the robotic monitor relative to the hydrocarbon tank; and extracting, by a machine learning module of the controller, a feature vector based on the heat detected by the heat sensor and the location of the robotic monitor relative to the hydrocarbon tank.

11. The method of claim 10, wherein the heat signature represents:

a first location of the hydrocarbon tank; and a second location of a second hydrocarbon tank of the hydrocarbon storage or transport facility, the second hydrocarbon tank adjacent to the hydrocarbon tank.

12. The method of claim 10, further comprising providing, by the machine learning module, the heat signature based on the feature vector, the heat signature representing an area of the hydrocarbon storage or transport facility corresponding to a surface of the hydrocarbon tank.

13. The method of claim 10, wherein the robotic monitor is configured to move in accordance with four or more degrees of freedom.

14. The method of claim 10, wherein the heat sensor is a radiometric heat sensor or a thermal camera.

15. The method of claim 10, further comprising transmitting, by one or more unmanned aerial vehicles (UAVs), aerial images of the hydrocarbon storage or transport facility to the plurality of robotic monitors, the one or more UAVs communicably coupled to the plurality of robotic monitors.

16. The method of claim 15, further comprising generating, by the controller, a second heat signature based on the aerial images.

17. The method of claim 15, further comprising launching, by the controller, the one or more UAVs from the hydrocarbon storage or transport facility, responsive to generating the heat signature.

18. The method of claim 10, further comprising:

detecting, by a flame detector, ultraviolet (UV) radiation emitted by the hydrocarbon tank, the flame detector communicably coupled to the robotic monitor; and transmitting, by the flame detector, a signal representing the UV radiation to the robotic monitor.

* * * * *